US005848731A

United States Patent [19]

Deering

[11] Patent Number: 5,848,731

[45] Date of Patent: Dec. 15, 1998

[54] DISPENSER FOR PERSONAL MATERIALS

[76] Inventor: Ron Deering, 5792 Lemon Ave., Cypress, Calif. 90630

[21] Appl. No.: 839,354

[22] Filed: Apr. 17, 1997

Related U.S. Application Data

[60] Provisional application No. 60/016,664 May 1, 1996.

[51] Int. Cl. [6] ..... B67D 5/56

[52] U.S. Cl. ..... 222/129; 222/212

[58] Field of Search ..... 222/94, 129, 212

[56] References Cited

U.S. PATENT DOCUMENTS

| | | | |
|---|---|---|---|
| 5,060,791 | 10/1991 | Zulauf | 222/129 |
| 5,397,017 | 3/1995 | Muza et al. | 222/192 |
| 5,598,254 | 1/1997 | Ikesue et al. | 222/129 |

FOREIGN PATENT DOCUMENTS

| | | | |
|---|---|---|---|
| 1558412 | 1/1969 | France | 222/192 |

*Primary Examiner*—Joseph A. Kaufman
*Attorney, Agent, or Firm*—Goldstein & Canino

[57] ABSTRACT

A dispensing device designed to be secured to a container, and to perform a cap function for the container. The dispenser is particularly designed to retain and dispense a plurality of different personal care items, such as lip-balm, lotions or cosmetics when the container is filled with fluids such as water or body lotion, or semi-solids such as sunscreen or skin creams. The dispenser includes a cup-shaped body having an inner annular wall interconnected to an outer annular wall by a circular bottom wall, the walls together defining a storage chamber in which to retain balm, cosmetics, condiments or other such substances. The inner wall of the body has internal threads for threadably engaging the dispenser with the neck of the container, the dispenser thus serving as the cap for the container. The dispenser further includes a capping lid that is releasably engaged over the body. The capping lid has a circular top wall with an annular sidewall depending from it. A centrally-located spout seal is positioned on the circular top wall of the capping lid so that when the lid is positioned over the body, it not only covers the body's storage chamber, but it also seals the opening in the container, thus preventing fluid from being emitted from the container when the lid is in place.

4 Claims, 3 Drawing Sheets

DISPENSER FOR PERSONAL MATERIALS

This application relates to subject matter disclosed in Provisional application Ser. No. 60/016,664 filed in the United States Patent Office on May 1, 1996.

BACKGROUND OF THE INVENTION

The present invention relates generally to dispensing devices, and has particular utility in the storage and dispensing of personal care items, such as balm, skin cream or cosmetics, in conjunction with a container filled with fluid or semi-solid personal care substances.

Virtually everyone uses some sort of personal care items, such as lip balm, sunscreen, lotion or cosmetics, and the number of individuals who use at least two or more personal care items is in the range of millions.

Among the above individuals, those who want or need to carry these items are usually inconvenienced, as they often have to carry with them several different individual dispensers. This arrangement can often lead to loss or misplacement of dispensers, and it also creates the inconvenience of having to locate each individual dispenser as needed. In addition, the carrying of many separate containers is not only inconvenient, but it takes up a large amount of space in a purse, suitcase or the like. Still further, when the necessary items are stored in several different containers, it is easy to inadvertently forget one or more of the containers when traveling.

In an attempt to remedy these problems, U.S. Pat. No. 5,054,662 issued to Santagiuliana discloses a cap with a dispenser for liquids. The dispenser has threads for attaching the dispenser to the opening of a fluid or semi-solid container. While this device is useful in allowing storage of a liquid, it is significantly limited in that the dispenser itself is designed to serve as a cap for the fluid or semi-solid container. This means that each time it is desired to access the fluid or semi-solid, the dispenser must be removed from the container, and then replaced again after the fluid or semi-solid has been accessed. This is an inconvenience, since the lower container cannot dispense directly from the top. Additionally, this device is specifically designed for liquids, and is not equipped to store and dispense semi-solid substances such as lip-balm or skin cream.

Therefore, there is a clear need for an improved dispenser designed to be used in conjunction with a container containing fluid or semi-solid substances. Such a needed device would be quickly and easily secured to a container of lotion, skin cream or the like so that the necessary balm or cosmetics and lotion are stored in a single unit. Such a device would also attach to the container in such a way as to be easily accessible, and yet it would not require that the dispenser be removed in order to access the contents of the container. The present invention provides these and other related advantages, as further detailed in the following summary.

SUMMARY OF THE INVENTION

It is the object of the present invention to provide a practical and convenient dispenser to be attached to a standard fluid or semi-solid container, so as to form a single unit in which a plurality of items are easily and conveniently retained. The present invention is particularly beneficial in the storage and dispensing of personal care items such as lip balm or cosmetics in conjunction with a container of body lotion, sunscreen or the like.

It is another object of the present invention to provide a compact, space saving balm dispenser which is readily attachable to the bottleneck of a fluid or semi-solid container, thus serving the dual function of cap for the container and storage area.

It is another object of the present invention to provide a dispenser designed so as to allow the contents of the fluid or semi-solid container to be easily accessed without removing the dispenser.

It is yet another object of the present invention to provide a practical and convenient balm dispenser which obviates the difficulty of carrying balm or cosmetics separately from body lotion. By combining two separate storage containers into a single unit, the present inventive arrangement also prevents smaller containers from being misplaced or forgotten.

It is another object of the present invention to include a plurality of chambers, each adapted to be filled with a different substance. For instance, one chamber might include balm, another chamber might include skin cream and another might include cosmetics, etc. Thus, when several different personal care items are needed, the present invention allows a single container to be utilized, rather than requiring the use of separate, individual containers for each personal care item.

It is another object of the present invention to provide a single capping lid that simultaneously closes the dispenser's chamber and seals the opening of the fluid container. This is a significant advantage of the present invention, as it allows contents of both the dispenser and the container to be easily accessed simply by removing the cap from engagement over the dispenser. This configuration also prevents both the personal care items stored in the dispenser and the fluid or semi-solid substance stored in the container from being accessed when the lid is in place over the dispenser.

Alternately, the present invention may be used to allow for the storage of two complimentary food items in a single unit. For example, the dispenser may be filled with peanut butter and secured to a container of jelly, or the dispenser may be filled with mustard and secured to a container of ketchup.

These objects and others to become apparent as the specification progresses are accomplished by the present invention, according to which, briefly stated, a balm dispenser includes at least one closeable chamber for storing balm therein, and means for attaching the balm dispenser to the opening of a fluid or semi-solid container such that the dispenser provides the function of a cap. The dispenser also includes a releasably mounted lid adjacent to the top so as to close the dispenser's and container's contents. The lid means includes a top wall and an annular sidewall.

BRIEF DESCRIPTION OF THE DRAWINGS

The foregoing objects of the invention, together with other objects and advantages which may be attained by its use, will become more apparent upon reading the following detailed description of the invention taken in conjunction with the drawings. In the drawings, where like reference numerals identify corresponding components.

DETAILED DESCRIPTION OF THE INVENTION

Figure 1:
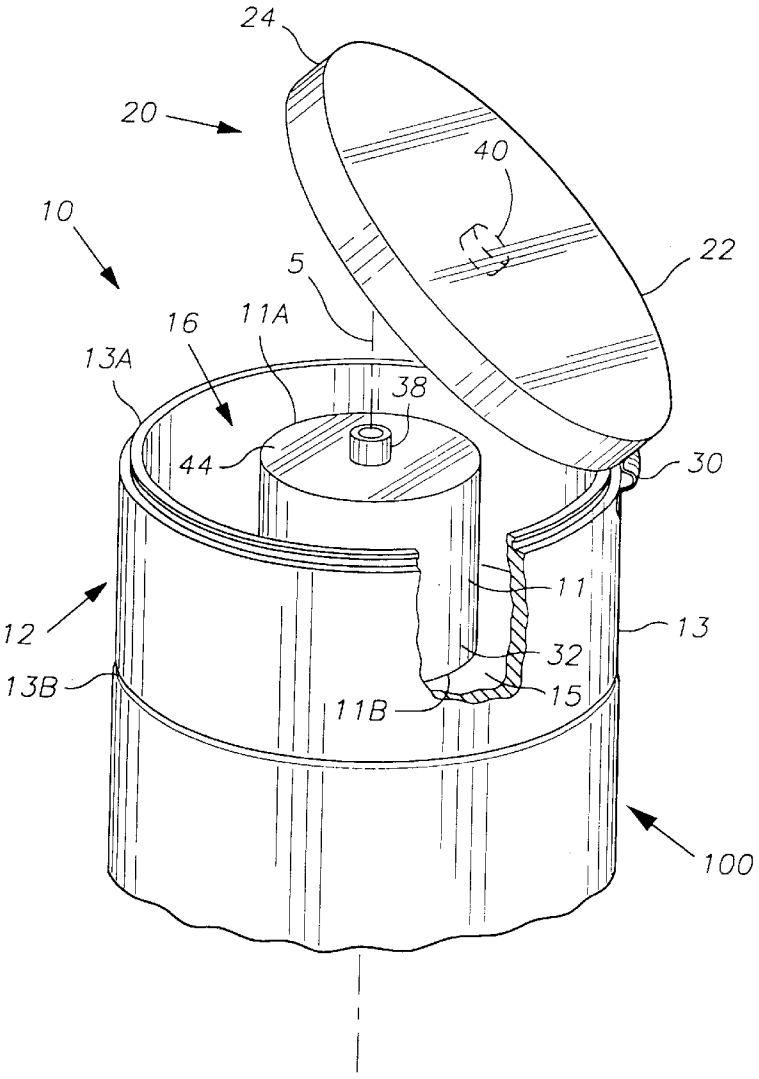
FIG. 1 is a diagrammatic representation of an opened dispenser according to a preferred embodiment of the present invention, secured to a neck of a container.
Figure 2:
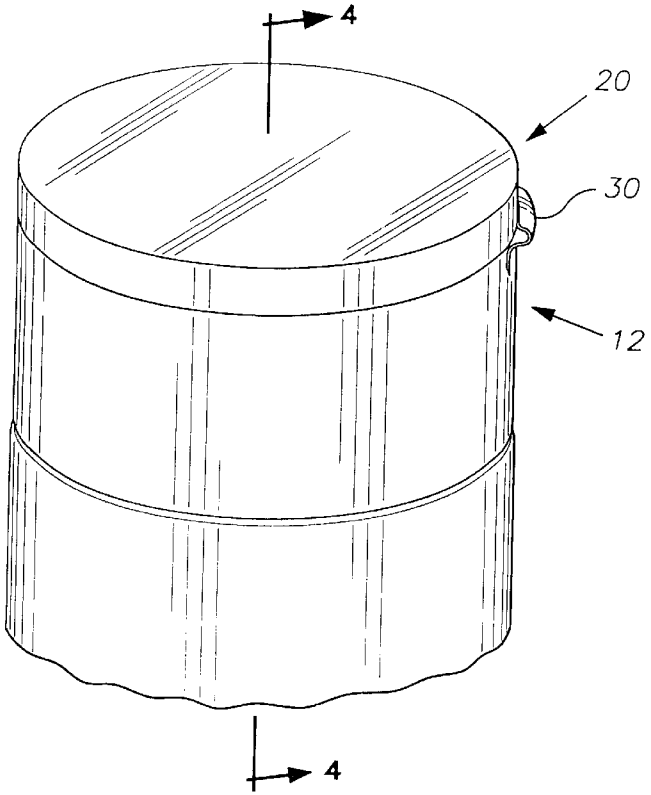
FIG. 2 is a diagrammatic representation of the dispenser of FIG. 1 shown in a closed position.

The present invention is a dispenser 10 designed for storing and dispensing a variety of different materials 56 such as balm, skin cream, cosmetics, toiletries or other personal care items, prior to their being used by an individual. Alternately, the device may be used for retaining and dispensing a wide variety of non-personal care materials 56 such as condiments, candy, peanut butter, etc. in conjunction with a container filled with related food items. For the purpose of clarity, the present invention will be detailed as it relates to storing and dispensing personal care items, although it is to be understood that the invention is in no way limited to such uses.

The present invention is designed for use in conjunction with a container 100 which has an upper end 101. The container 100 terminates, at said upper end 101, with an upfacing container wall 110 having a centrally-positioned externally-threaded neck 120 with a neck opening 130 located at an end thereof, to allow a fluid or semi-solid substance 58 to be transferred into and out of the container 100 via said neck opening 130 as desired. Such container configurations are well known in the art and are used to contain and dispense a wide variety of fluid or semi-solids substances such as sunscreen, lotion, drinking fluid or the like.

Figure 4:
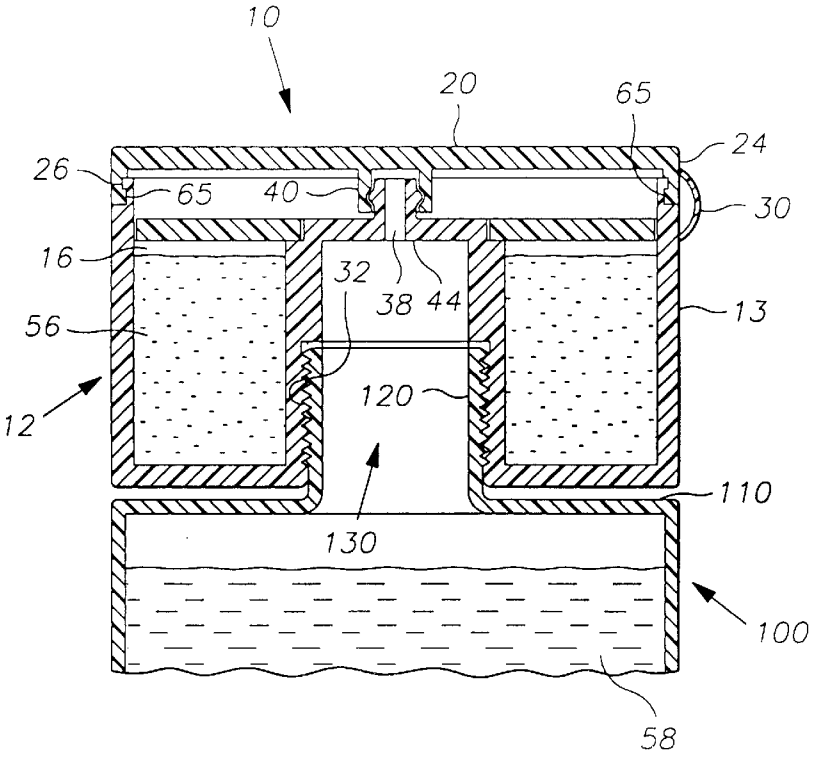
FIG. 4 is a cross-section view of the dispenser of FIG. 1.
Figure 5:
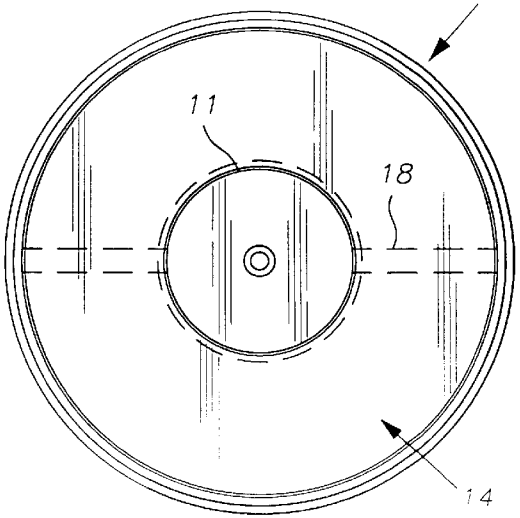
FIG. 5 is a top plan view of a second embodiment of the dispenser of the instant invention.

As best seen in FIG. 1, the present inventive dispenser 10 consists generally of a cylindrical body 12 and a capping lid 20 with a corresponding longitudinal axis 5. The cylindrical body 12 is comprised of an inner annular wall 11, an outer annular wall 13, and a circular, bottom base wall 15. The inner annular wall 11 has a top edge 11A and a bottom edge 11B. Likewise, the outer annular wall 13 has a top edge 13A and a bottom edge 13B. The bottom base wall 15 extends between the bottom edge 11B of the inner annular wall 11 and the bottom edge 13B of the outer annular wall 13. Together the walls define an annulus or open chamber 16 within the body 12 in which to store balm, cosmetics or the like. As best seen in FIG. 4, an annular lip 44 protrudes inwardly from the top edge 11A of the inner annular wall 11 and defines a small spout hole 38 through which the substance 58 can be emitted from the container 100 when the dispenser 10 is positioned on the container 100. The inner annular wall 11 includes an internally threaded portion 32 gauged to inter-engage with the externally threaded neck 120 of the container 100. The height of the inner annular wall 11 is preferably approximately equal to the height of the externally threaded neck 120 of the container 100.

Figure 3:
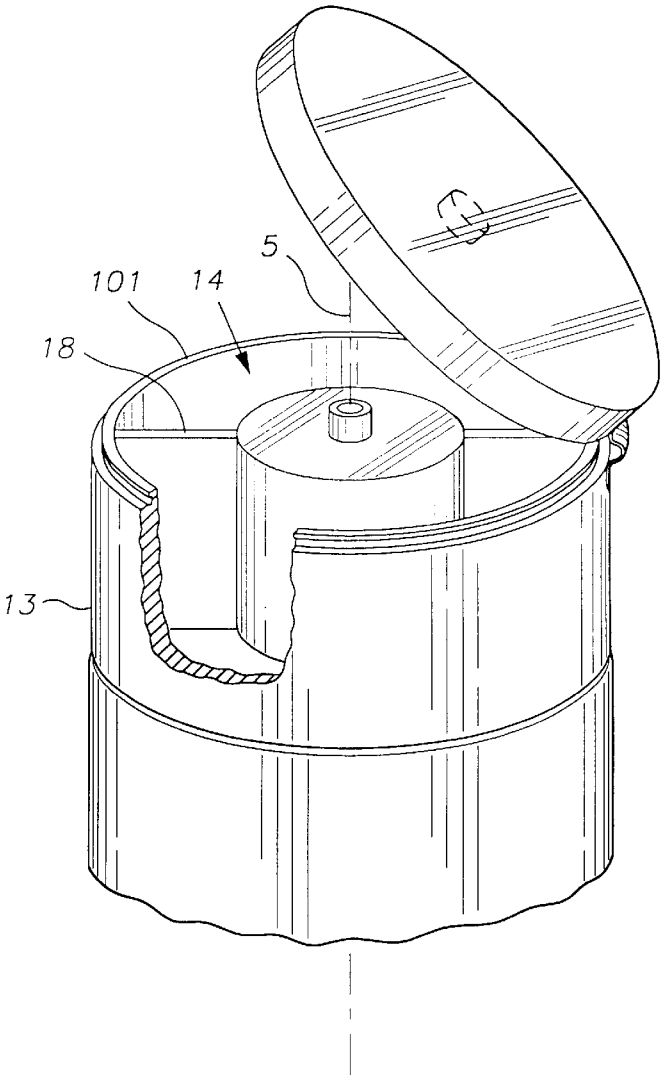
FIG. 3 is a diagrammatic representation of partitions within the dispenser of FIG. 1.

In one preferable embodiment, best seen in FIG. 3, the body's open chamber 16 is separated by partitions 18 so as to be divided into a plurality of smaller sub-chambers 14 so as to increase the number of different materials 56 that can be separately contained within a single dispenser 10. The partitions 18 are preferably formed integrally with the walls of the body 12, so that the entire body 12 is formed as a single, molded part. Although only two sub-chambers 14 and partitions 18 have been indicated with reference numbers in FIG. 3, it is to be understood that numerous partitions 18 could be positioned within the open chamber 16 so as to extend about the circumference of the cylindrical body 12, as clearly shown in the drawings.

Figure 6:
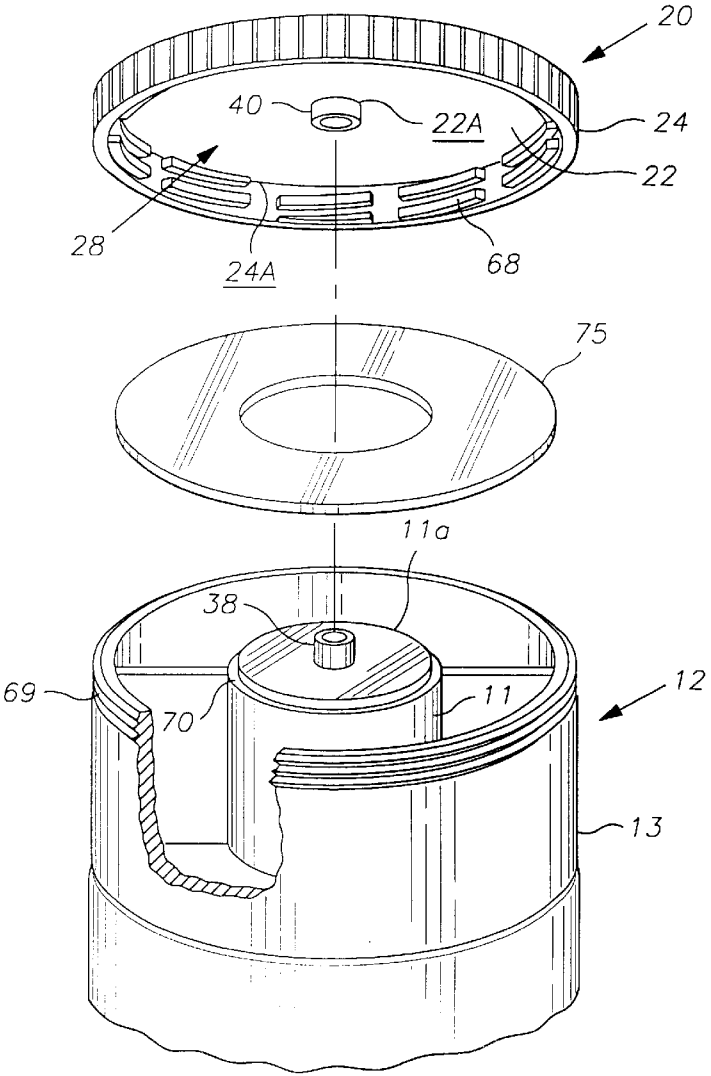
FIG. 6 is an exploded view of the second embodiment of the present invention.

A transverse capping lid 20 is also included with the present inventive dispenser 10, with various embodiments of said lid seen in FIGS. 1 and 6. Preferably the lid 20 is constructed of high density polyethylene or polypropylene, and the remainder of the dispenser is formed of similar material. The capping lid 20 is designed both to cover the open chamber 16 of the cylindrical body 12 and to seal closed the spout hole 38. As best seen in FIG. 6, the lid 20 preferably comprises a solid, circular top wall 22 and an annular sidewall 24 extending downward from the top wall 22. Both the circular top wall 22 and the annular side wall 24 have an infacing surface, 22A and 24A respectively. A centrally-located spout seal 40 extends downwardly from the infacing surface 22A of the circular top wall 22 of the capping lid 20. The spout seal 40 is designed to releasably co-act with the spout hole 38 so as to seal the neck opening 130 of container 100.

It should be noted that the annular sidewall 24 can be constructed with any desired fixed height. The greater the height of the sidewall, the greater the height of the spout seal 40 extending from the top circular wall 22 of the capping lid 20. In one preferred embodiment, the annular sidewall 24 of the cap 20 has a height great enough so as to define, together with the circular top wall 22, a cap storage chamber 28 in which materials 56 may be retained. Additionally, partitions 18 may be positioned in the capping lid 20 so as to divide the cap storage chamber 28 into a plurality of smaller sub-chambers (not shown) for retaining a plurality of items.

Preferably, the lid 20 is attached to body 12 so that it cannot be inadvertently removed therefrom. In this embodiment, best illustrated in FIG. 4, lid 20 is secured to the outer annular wall 13 by a integral flexible hinge 30. In this way the dispenser can be perceived as a single integral unit. Thus, as clearly illustrated, the lid 20 is positioned over and secured to the open chamber 16 of the body 12. The lower portion of the lid's annular sidewall 24 is adjacent to the outer annular wall 13 of the cylindrical body 12, thereby reasonably sealing the open chamber 16 closed so that the enclosed materials 56 are not exposed. There are many ways by which the capping lid 20 may be releasably engaged with the body 12. In one preferred embodiment, a circumferential recess 26 extends completely around the periphery of the lower portion of the infacing surface 24A of the lid's sidewall 24. The recess 26 is designed to releasably co-act with a mating annular boss 65 extending from the top edge 13A of the body's outer wall 13 so as to seal closed the chamber 16 of the body 12. In the preferred embodiment, the overall diameter of the lid 20 is slightly larger than the outer diameter of the annular boss 65. However, as various snap-on lid configurations are notoriously well known in the art as means by which to easily dispense fluid or semi-solid 58 from a container 100 without necessitating that the entire cap be removed, it should be noted that the present invention is in no way limited to the above described embodiment, but rather, any number of snap-on lid configurations may also be implemented within the scope of the present invention.

FIG. 6 illustrates an alternate embodiment of the present invention in which the lid 20 is not attached to the body 12, but rather is formed separate from the body 12. In this embodiment threads 68 are positioned on the infacing surface 24A of the sidewall 24 of the lid 20, and mating threads 69 are positioned on the outer surface of the outer annular wall 13, near the wall's top edge 13A. Thus, to access the contents of the chamber 16 or the container 100, the lid 20 must be unscrewed from engagement with the body 12. This embodiment is particularly better suited for storing balm in the lid's storage chamber 28 rather than in the dispenser's chamber 16, since the weight of the balm in the lid 20 could potentially cause premature failure of the flexible hinge 30. Alternately, an annular boss (not shown) may be positioned in the outer annular wall 13 as to allow the lid 20 to snap into the body as the lid 20 is seated. However, while these are preferable embodiments, it should be noted that there are many other sealing means well-known in the art that could also be employed.

In one preferred embodiment, as shown in FIG. 6, grooves 70 may be positioned in the inner annular wall 11 of the body 12, near the top edge 11A of the wall 11. A removable disk-shaped divider 75 is provided, the divider 75 being shaped and sized to snap into these grooves 70 and cover chamber 16. Thus, when the divider 75 is firmly engaged with the grooves 70, the divider 75 prevents substance 58 from contacting items stored in the chamber 16 when substance 58 is emitted from the container 100. In addition, the divider 75 serves to prevent items stored in the body's open chamber 16 from contacting and intermixing with items stored in the cap storage chamber 28 when the lid 20 is engaged over the body 12. However, while these are preferable embodiments, it should be noted that there are many other separating and dividing means well-known in the art that could also be employed to isolate the relative products.

Thus, to use the present inventive dispenser 10, the container 100 is filled with a fluid or semi-solid, such as water, lotion or the like. The dispenser 10 is thereafter attached to the container 100 by gripping the dispenser's cylindrical body 12, aligning the internal threaded portion 32 of the inner annular wall 11 with the externally threaded neck 120 of the fluid or semi-solid container 100. As the dispenser and container are threaded together, the body 12 is brought down around the threaded neck 120 until the cylindrical body 12 rests in a seated position around the bottom of the neck 120. When the dispenser 10 is properly positioned on the container, the bottom base wall 15 of the body 12 contacts or nearly contacts the upfacing container wall 110 of the fluid or semi-solid container 100, and the dispenser's spout hole 38 formed by lip 44 is aligned with the neck opening 130 in the container 100, thus allowing substance 58 from being emitted from the container 100 when the dispenser is positioned in engagement with the container 100. The present inventive dispenser in this way serves as a cap for the neck opening 130 of fluid or semi-solid container 100 in addition to providing a means for storing and dispensing balm or cosmetics. When the capping lid 20 of the dispenser 10 is secured over the chamber 16, the lid closes the chamber 16 and the spout seal 40 seals the spout hole 38 closed, thus simultaneously preventing substance 58 from being discharged from the container 100 and preventing access to the chamber 16 when the capping lid 20 is in place.

The present invention is designed to prevent any fluid or semi-solid substance 58 contained within the container 100 from being accidentally released from the container 100 into the dispenser 10 upon emitting fluid 58. This is particularly accomplished by means of the divider 75. In addition, a sealing barrier (not shown), such as a thin plastic sheet or the like, may be positioned over the contents of the sub-chambers 14 during production so as to avoid movement of the enclosed items during storage and shipping. The container 100 and balm dispenser 10 combination thus assembled can be easily carried in a purse, or even pocket, particularly if the container is of small size, such as a eight ounce capacity bottle or four ounce tube, without the inconvenience of carrying a separate container and balm or other such dispenser.

When it is desired to access substance 58 from the container 100, the snap-open lid 20 is simply pulled upwardly without disturbing the positioning of the dispenser 10 around the container neck 120, and without requiring that the dispenser 10 be removed from its position over the container 100. As substance 58 is squeezed from the container 100, the divider 75 prevents the substance from contacting the balm, lotion or other such items contained in the body's chamber 16. To even further avoid contamination, the container 100 should be inverted when dispensing substance 58.

The foregoing is a complete description of the present invention. Various changes may be made without departing from the spirit and scope of the invention. While the invention has been herein shown and described in what is presently conceived to be the most practical and preferred embodiment, it will be obvious to one of ordinary skill in the art that many modifications may be made thereof within the scope of the invention. For instance, the cylindrical body could be of any shape and dimensions depending upon the material to be held and the environment in which it will be used.

What is claimed is:

1. A dispenser for storing and dispensing personal materials including balms, cosmetics, and medications, removeably secured to a container which possess a substance therein, the dispenser comprising:

a) a cylindrical body comprising an inner annular wall, an outer annular wall and a bottom base wall which extends between the inner annular wall and outer annular wall, said walls defining an open chamber for storing personal materials;

b) an internally threaded portion located upon the inner annular wall, configured to inter-engage with an externally threaded neck of the container so that the dispenser, and personal materials contained within the open chamber thereof, can be removeably secured to the container;

c) an annular lip located upon the inner annular wall, said annular lip defining a spout hole which is in fluid communication with a neck opening of the container, thus allowing the substance contained within the container to be emitted from said container via the spout hole, without contacting the personal materials stored within the open chamber; and d) a lid having a circular top wall, an annular sidewall extending downward around the circumference of said circular ton wall, a spout seal projecting downwards from the circular top wall towards the spout hole, and a flexible hinge integral with the lid and secured to the outer annular wall, whereby the spout seal is sized to engage the spout hole, thus sealing said spout hole and preventing substance from escaping the container therethrough.

2. The dispenser of claim 1, wherein the annular sidewall and the circular top wall of the cap define a cap storage chamber for storing and dispensing personal materials, in addition to and distinct from the open chamber formed by the inner annular wall, outer annular wall and bottom base wall of the body of the dispenser.

3. The dispenser of claim 2, wherein grooves are inscribed upon the inner annular wall of the body of the dispenser, and a removable disk-shaped divider is sized to engage said grooves and secure thereto, thus providing means of segregating the material contained within the cap storage chamber from that material contained within the open chamber, as well as providing means for preventing the substance contained within the container from contacting the material contained within the chambers.

4. The dispenser of claim 3, wherein partitions located within the open chamber of the body of the dispenser segregate said open chamber into a plurality of sub-chambers to increase the variety of materials which can be contained and effectively segregated therein.

* * * * *